US008249495B2

(12) United States Patent
Kohara

(10) Patent No.: US 8,249,495 B2
(45) Date of Patent: Aug. 21, 2012

(54) IMAGE FORMING APPARATUS

(75) Inventor: Ryuichi Kohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/152,927

(22) Filed: Jun. 3, 2011

(65) Prior Publication Data

US 2011/0229167 A1 Sep. 22, 2011

Related U.S. Application Data

(62) Division of application No. 11/898,414, filed on Sep. 12, 2007, now abandoned.

(30) Foreign Application Priority Data

Sep. 27, 2006 (JP) ..... 2006-262689

(51) Int. Cl.
*G03G 15/00* (2006.01)

(52) U.S. Cl. ..... 399/405; 399/389

(58) Field of Classification Search ..... 399/405, 399/389

See application file for complete search history.

(56) References Cited

U.S. PATENT DOCUMENTS

| | | | | |
|---|---|---|---|---|
| 5,237,382 | A | 8/1993 | Matsumura | |
| 6,246,491 | B1 | 6/2001 | Matsumoto et al. | |
| 6,314,252 | B1 * | 11/2001 | Matsumoto | 399/45 |
| 6,539,198 | B2 | 3/2003 | Miyajima | |
| 6,963,721 | B2 * | 11/2005 | Asai et al. | 399/391 |
| 7,043,191 | B2 * | 5/2006 | Fujii et al. | 399/367 |
| 7,467,337 | B2 * | 12/2008 | Nakamura et al. | 714/704 |
| 7,686,291 | B2 * | 3/2010 | Miyazawa | 271/117 |
| 2003/0021608 | A1 * | 1/2003 | Morita et al. | 399/23 |

FOREIGN PATENT DOCUMENTS

| | | | |
|---|---|---|---|
| JP | 64-055269 | A | 3/1989 |
| JP | 07-061695 | A | 3/1995 |
| JP | 08-030050 | A | 2/1996 |
| JP | 2000-194239 | A | 7/2000 |
| JP | 2002-037540 | A | 2/2002 |
| JP | 2004-338202 | A | 12/2004 |
| JP | 2006-171371 | A | 6/2006 |

* cited by examiner

*Primary Examiner* — Anthony Nguyen

(74) *Attorney, Agent, or Firm* — Kubotera & Associates, LLC

(57) ABSTRACT

An image forming apparatus includes a sheet supply unit for supplying a printing medium; and a sheet discharge unit for discharging the printing medium after an image is transferred to the printing medium. Further, the image forming apparatus includes a transport path medium number storage unit for storing a transport path medium number; a discharge number storage unit for storing a discharge number; an upper limit print number storage unit for storing an upper limit print number; an addition unit for calculating an addition sum of the discharge number and the transport path medium number; a number comparison unit for comparing the addition sum with the upper limit print number; and a sheet supply stop unit for stopping the sheet supply unit when the addition sum exceeds the upper limit print number.

3 Claims, 16 Drawing Sheets

335

| Printing medium size | Transport path medium number |
|---|---|
| A5LEF | 6 |
| A5SEF | 4 |
| A4LEF | 4 |
| A4SEF | 3 |
| B4 | 2 |
| A3 | 2 |
| ⋮ | ⋮ |

FIG. 4

336

| Printing medium size \ Sheet supply unit | First sheet supply unit | Second sheet supply unit |
|---|---|---|
| A5LEF | 6 | 7 |
| A5SEF | 4 | 5 |
| A4LEF | 4 | 5 |
| A4SEF | 3 | 3 |
| B4 | 2 | 2 |
| A3 | 2 | 2 |
| ⋮ | ⋮ | ⋮ |

FIG. 16

IMAGE FORMING APPARATUS

CROSS-REFERENCE TO RELATED APPLICATIONS

This is a divisional application of the prior application Ser. No. 11/898,414 filed Sep. 12, 2007, now abandoned.

BACKGROUND OF THE INVENTION

The present invention relates to an image forming apparatus having a sheet supply unit for supplying a printing medium and a sheet discharge unit for discharging the printing medium after an image is transferred to the printing medium.

A conventional image forming apparatus such as a printer includes a function of administrating the number of printed sheets or print number (refer to Patent Reference). The conventional image forming apparatus is provided with a counter for counting the print number, so that the counter is updated every time a printing medium is discharged. An administrator monitors the counter regularly for managing the print number.

Patent Reference: Japanese Patent Publication No. 2000-194239

In the conventional image forming apparatus, when a printing operation is performed continuously, before a precedent printing medium is discharged from the image forming apparatus, a subsequent printing medium is supplied. Accordingly, even though an upper limit is set at a specific print number to stop the printing operation, an actual print number may exceed the upper limit.

In view of the problems described above, an object of the invention is to provide an image forming apparatus, in which, it is possible to stop a printing operation at an upper limit when the upper limit is set at a specific print number.

Further objects and advantages of the invention will be apparent from the following description of the invention.

SUMMARY OF THE INVENTION

In order to attain the objects described above, according to a first aspect of the present invention, an image forming apparatus includes a sheet supply unit for supplying a printing medium; and a sheet discharge unit for discharging the printing medium after an image is transferred to the printing medium.

Further, the image forming apparatus includes a transport path medium number storage unit for storing a transport path medium number or a number of printing media in a transport path disposed between the sheet supply unit and the sheet discharge unit when the sheet supply unit supplies the printing medium and the sheet discharge unit discharges the printing medium; a discharge number storage unit for storing a discharge number or a number of the printing media discharged from the sheet discharge unit, and for updating the discharge number by adding one to the discharge number when the sheet discharge unit discharges the printing medium; an upper limit print number storage unit for storing an upper limit print number or a maximum number of the printing media that the sheet discharge unit is capable of discharging; an addition unit for calculating an addition sum of the discharge number stored in the discharge number storage unit and the transport path medium number stored in the transport path medium number storage unit when the sheet discharge unit discharges the printing medium; a number comparison unit for comparing the addition sum calculated by the addition unit with the upper limit print number stored in the upper limit print number storage unit; and a sheet supply stop unit for stopping the sheet supply unit when the number comparison unit compares the addition sum with the upper limit print number, and the addition sum exceeds the upper limit print number.

In the first aspect of the present invention, when the number comparison unit compares the addition sum with the upper limit print number, and the addition sum exceeds the upper limit print number, the sheet supply stop unit stops the sheet supply unit. Accordingly, when the print number reaches the upper limit print number, the sheet supply unit does not supply the printing medium, thereby preventing the printing operation from exceeding the upper limit print number.

According to a second aspect of the present invention, the sheet supply unit may include a plurality of sheet supply sections according to different types of printing media. A printing medium supply detection unit is disposed in each of the sheet supply sections. The transport path medium number storage unit stores the transport path medium number in advance with respect to each of the sheet supply sections. The addition unit calculates the addition sum of the discharge number stored in the discharge number storage unit and the transport path medium number stored in the transport path medium number storage unit every time the sheet discharge unit discharges the printing medium.

In the second aspect of the present invention, the printing medium supply detection unit is disposed in each of the sheet supply sections. Accordingly, it is possible to quickly detect the printing medium upon supplying, thereby increasing a speed of the printing operation.

According to a third aspect of the present invention, an image forming apparatus includes a sheet supply unit for supplying a printing medium; and a sheet discharge unit for discharging the printing medium after an image is transferred to the printing medium.

Further, the image forming apparatus includes a transport path medium number storage unit for storing a transport path medium number or a number of printing media in a transport path disposed between the sheet supply unit and the sheet discharge unit when the sheet supply unit supplies the printing medium and the sheet discharge unit discharges the printing medium, and for updating the transport path medium number by adding one to the transport path medium number when the sheet supply unit supplies the printing medium and by subtracting one from the transport path medium number when the sheet discharge unit discharges the printing medium; a discharge number storage unit for storing a discharge number or a number of the printing media discharged from the sheet discharge unit, and for updating the discharge number by adding one to the discharge number when the sheet discharge unit discharges the printing medium; an upper limit print number storage unit for storing an upper limit print number or a maximum number of the printing media that the sheet discharge unit is capable of discharging; an addition unit for calculating an addition sum of the discharge number stored in the discharge number storage unit and the transport path medium number stored in the transport path medium number storage unit when the sheet discharge unit discharges the printing medium; a number comparison unit for comparing the addition sum calculated by the addition unit with the upper limit print number stored in the upper limit print number storage unit; and a sheet supply stop unit for stopping the sheet supply unit when the number comparison unit compares the addition sum with the upper limit print number, and the addition sum exceeds the upper limit print number.

In the third aspect of the present invention, when the number comparison unit compares the addition sum with the upper limit print number, and the addition sum exceeds the upper limit print number, the sheet supply stop unit stops the sheet supply unit. Accordingly, when the print number reaches the upper limit print number, the sheet supply unit does not supply the printing medium, thereby preventing the printing operation from exceeding the upper limit print number.

According to a fourth aspect of the present invention, the sheet supply unit may include a plurality of sheet supply sections according to different types of printing media. A printing medium supply detection unit is disposed in the sheet supply unit for detecting the printing medium supplied from one of the sheet supply units. A printing medium discharge detection unit is disposed for detecting the printing medium discharged from the sheet discharge unit. The transport path medium number storage unit updates the transport path medium number by adding one to the transport path medium number when the printing medium supply detection unit detects the printing medium supplied from one of the sheet supply sections, and by subtracting one from the transport path medium number when the printing medium discharge detection unit detects the printing medium discharged from the sheet discharge unit.

In the fourth aspect of the present invention, the printing medium supply detection unit is disposed in each of the sheet supply sections. Accordingly, it is possible to quickly detect the printing medium upon supplying, thereby increasing a speed of the printing operation.

As described above, in the present invention, when the print number reaches the upper limit print number set in advance, the sheet supply unit does not supply the printing medium, thereby preventing the printing operation from exceeding the upper limit print number.

BRIEF DESCRIPTION OF THE DRAWINGS

FIG. 4 is a schematic view showing an example of a table shown in FIG. 3 according to the first embodiment of the present invention;

FIG. 16 is a schematic view showing an example of a table in a print control system of the image forming apparatus according to the third embodiment of the present invention.

DESCRIPTION OF THE PREFERRED EMBODIMENTS

Hereunder, embodiments of the present invention will be explained with reference to the accompanying drawings. In the description below, a color printer is described as an example of an image forming apparatus.

First Embodiment

Figure 1:
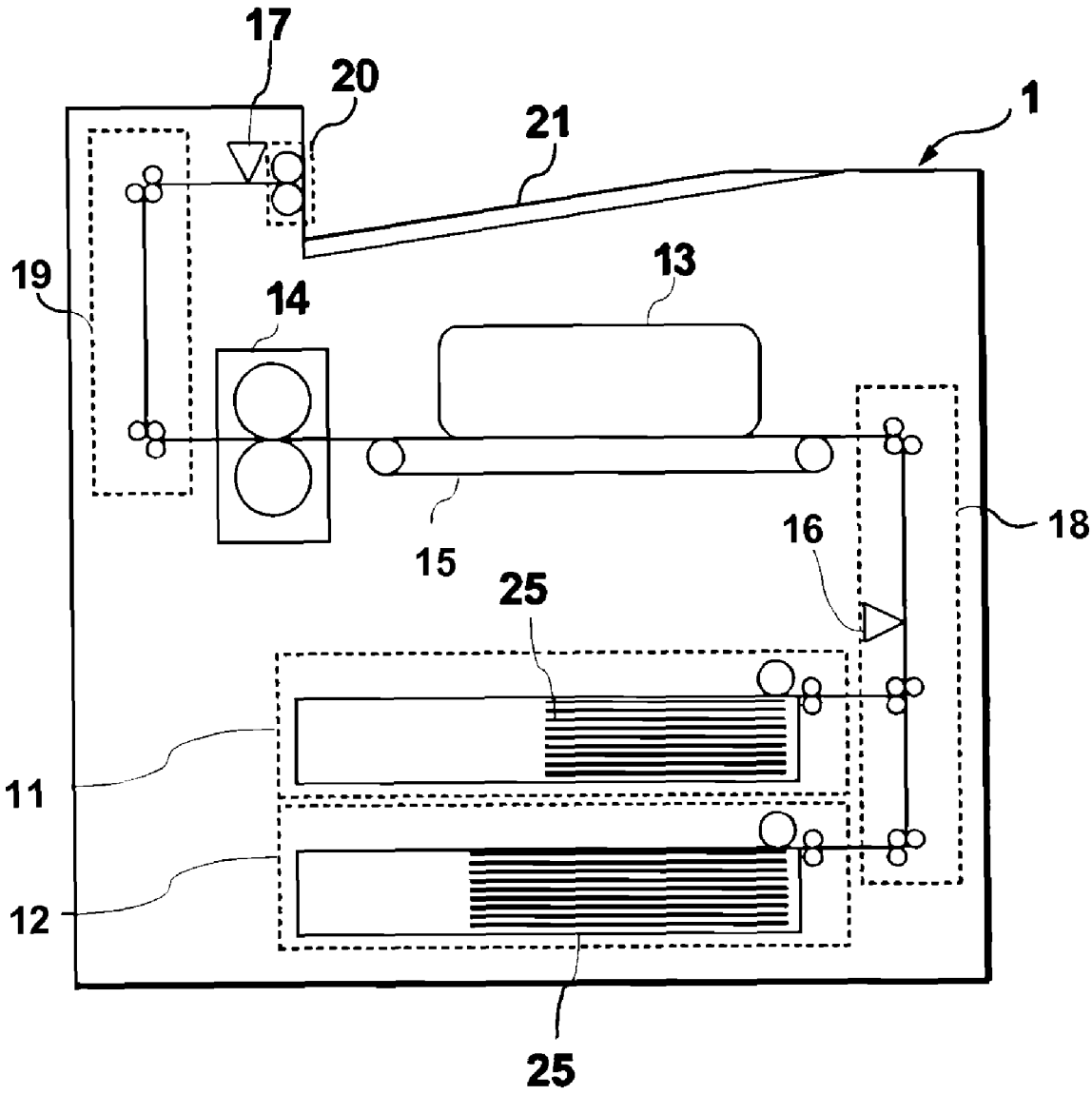
FIG. 1 is a schematic sectional view showing an image forming apparatus according to a first embodiment of the present invention.

A first embodiment of the present invention will be explained. FIG. 1 is a schematic sectional view showing an image forming apparatus 1 according to the first embodiment of the present invention. The image forming apparatus 1 is an apparatus such as a printer for printing image data sent from a host device such as a personal computer.

As shown in FIG. 1, the image forming apparatus 1 includes a first sheet supply unit 11 for storing a printing medium 25 having an A4 size; a second sheet supply unit 12 for storing the printing medium 25 having an A3 size; a developing unit 13 for forming a toner image through an electric-photography process and transferring the toner image to the printing medium 25; a fixing unit 14 for fixing the toner image transferred to the printing medium 25; a transfer belt 15 for transporting the printing medium 25 upon transferring; and an entrance sensor 16 disposed on a first transport unit 18 for detecting the printing medium 25 supplied from the first sheet supply unit 11 or the second sheet supply unit 12. In the embodiment, the first sheet supply unit 11 and the second sheet supply unit 12 constitute a sheet supply unit.

The image forming apparatus 1 further includes a discharge sensor 17 disposed between a second transport unit 19 and a discharge roller 20 for detecting the printing medium 25 discharged; the first transport unit 18 for transporting the printing medium 25 thus discharged to the transfer belt 15; the second transport unit 19 for transporting the printing medium 25 from the fixing unit 14 to the discharge roller 20; the discharge roller 20 for transporting the printing medium 25 to a discharge sheet tray 21; the discharge sheet tray 21 for placing the printing medium 25 discharged from the discharge roller 20; and a print control system (not shown in FIG. 1) for controlling a printing operation. In the embodiment, the discharge roller 20 and the discharge sheet tray 21 constitute a sheet discharge unit.

Figure 2:
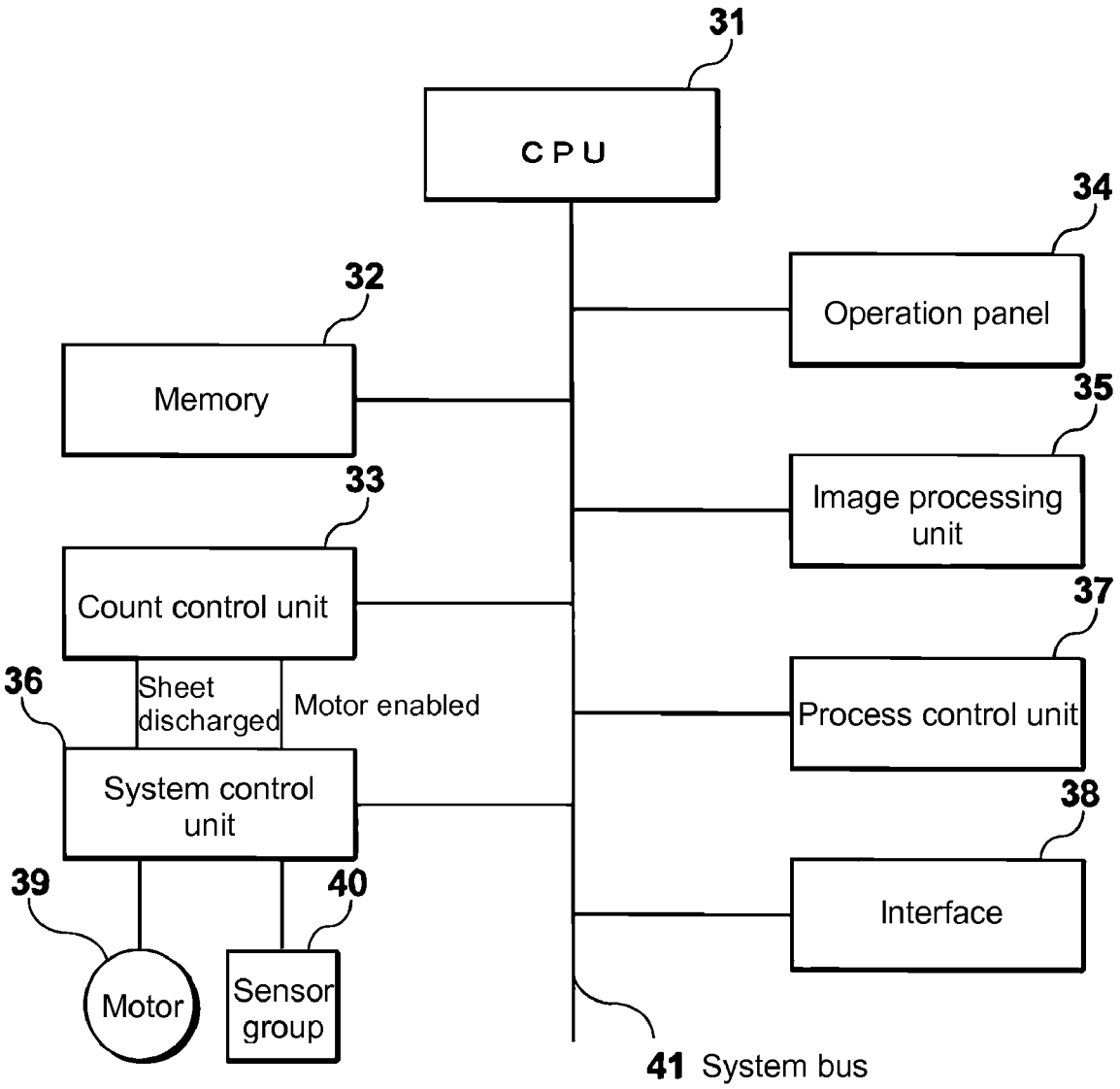
FIG. 2 is a block diagram showing a print control system of the image forming apparatus according to the first embodiment of the present invention.

FIG. 2 is a block diagram showing the print control system of the image forming apparatus 1 according to the first embodiment of the present invention. As shown in FIG. 2, the print control system includes a central processing unit (CPU) 31; a memory 32; a count control unit 33; an operation panel 34; an image processing unit 35; a system control unit 36; a process control unit 37; an interface 38; a motor 39; and a sensor group 40.

In the embodiment, a system bus 41 is connected to the central processing unit (CPU) 31; the memory 32; the count control unit 33; the operation panel 34; the image processing unit 35; the system control unit 36; the process control unit 37; and the interface 38. The motor 39 and the sensor group 40 are connected to the system control unit 36.

In the embodiment, according to a print control program stored in the memory 32, the CPU 31 controls the memory 32; the count control unit 33; the operation panel 34; the image processing unit 35; the system control unit 36; the process control unit 37; and the interface 38.

In the embodiment, the memory 32 includes a random-access-memory (RAM), a read-only-memory (ROM), and the likes, and stores a program to be executed with the CPU 31 and print data input from the interface 38. The memory 32 further stores a print possibility flag indicating whether the printing medium 25 is supplied. When the print possibility flag is "ON", the printing medium 25 is supplied. When the print possibility flag is "OFF", the printing medium 25 is stopped.

Figure 3:
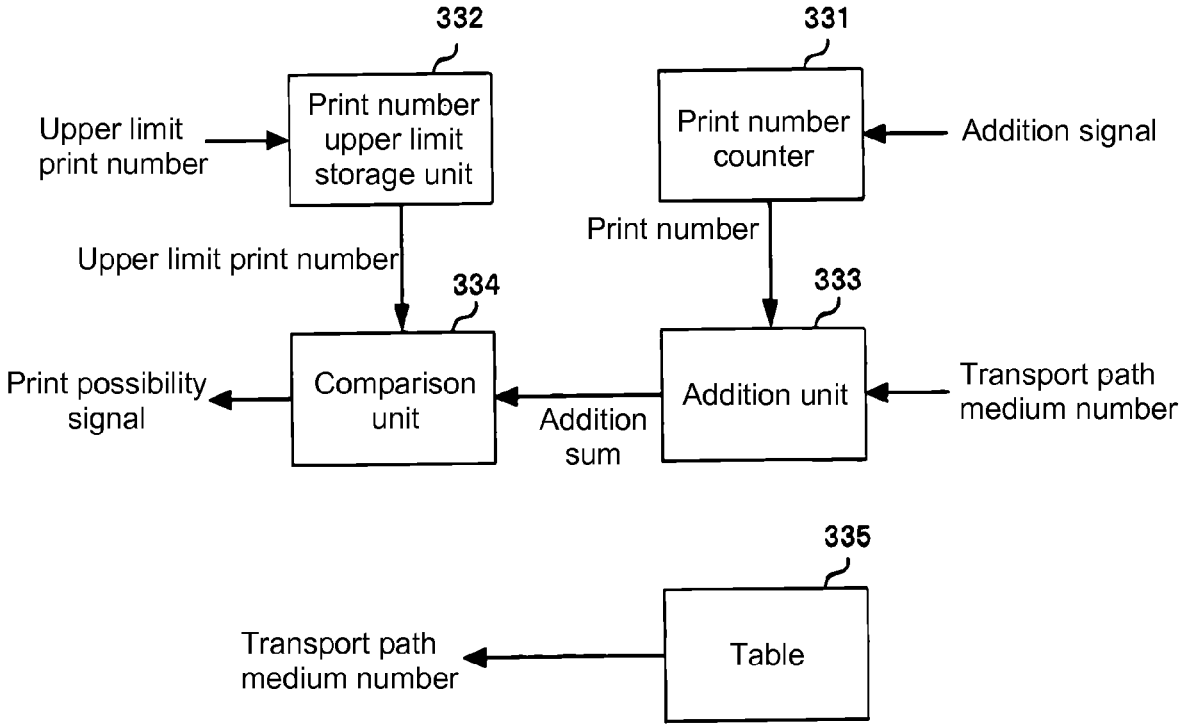
FIG. 3 is a block diagram showing a count control unit shown in FIG. 2 according to the first embodiment of the present invention.

FIG. 3 is a block diagram showing the count control unit 33 shown in FIG. 2 according to the first embodiment of the present invention. In the embodiment, the count control unit 33 manages a print number or a number of printed sheets, and determines whether the printing operation is performed. As shown in FIG. 3, the count control unit 33 includes a print number counter 331; a print number upper limit storage unit 332; an addition unit 333; a comparison unit 334; and a table 335.

In the embodiment, the print number counter 331 stores a discharge number or a number of the printing media 25 discharged to the discharge sheet tray 21. Every time when the printing medium 25 is discharged to the discharge sheet tray 21, the CPU 31 send an addition signal to the print number counter 331, so that the print number counter 331 adds one to the discharge number stored in advance. The print number upper limit storage unit 332 stores an upper limit print number or a maximum number of the printing media 25 that the sheet discharge unit is capable of discharging to the discharge sheet tray 21. An administrator inputs the upper limit print number through the operation panel 34.

In the embodiment, the addition unit 333 calculates an addition sum or an addition number by adding a transport path medium number stored in the table 335 to the discharge number stored in the print number storage unit 331 when the sheet discharge unit discharges the printing medium, and then sends the addition sum to the comparison unit 334.

In the embodiment, the comparison unit 334 compares the addition sum input from the print number counter 331 with the upper limit print number stored in the print number upper limit storage unit 332. When the addition sum exceeds the upper limit print number, the comparison unit 334 sends a print possibility signal to the CPU 31 through the system bus 41, so that the printing operation is not performed. When the addition sum is less than the upper limit print number, the comparison unit 334 sends the print possibility signal to the CPU 31 through the system bus 41, so that the printing operation is performed.

FIG. 4 is a schematic view showing an example of the table 335 shown in FIG. 3 according to the first embodiment of the present invention. As shown in FIG. 4, according to the sizes of the printing media 25, the table 335 stores in advance the transport path medium number or a number of the printing media 25 in the first transport unit 18, the transfer belt 15, and the second transport unit 19 on a downstream side of the entrance sensor 16 when the printing medium 25 is supplied to the first sheet supply unit 11 or the second sheet supply unit 12, and the printing medium 25 is discharged to the discharge sheet tray 21.

Figure 5:
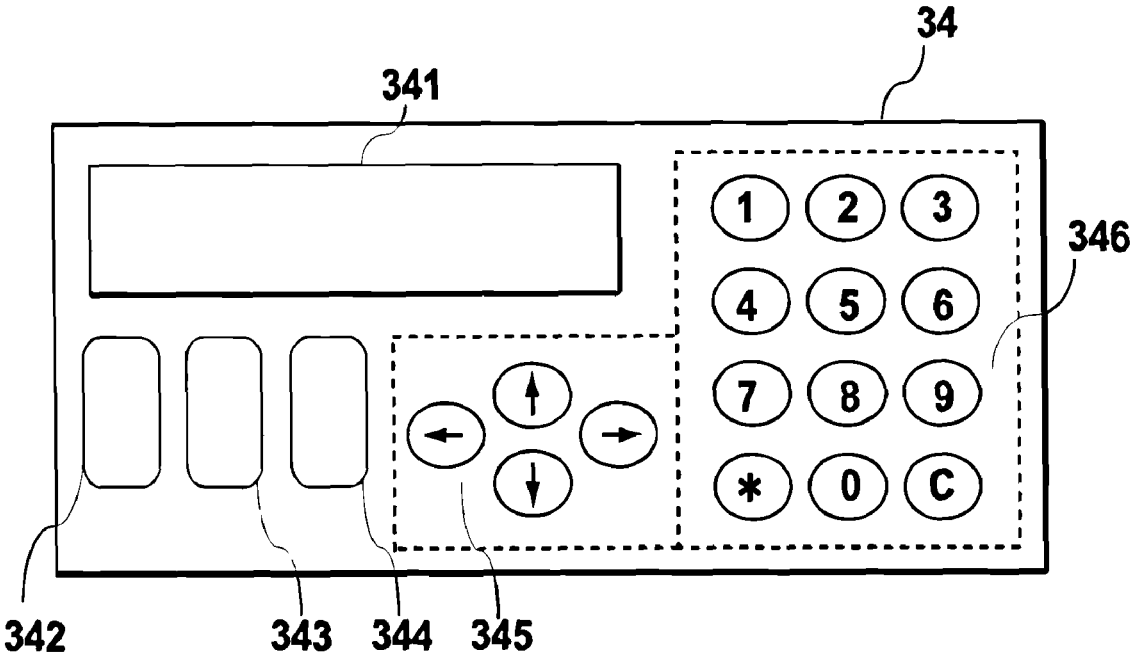
FIG. 5 is a schematic view showing an operation panel shown in FIG. 2 according to the first embodiment of the present invention.

FIG. 5 is a schematic view showing the operation panel 34 shown in FIG. 2 according to the first embodiment of the present invention. The operation panel 34 receives an input from a user, and displays a status of the image forming apparatus 1. As shown in FIG. 5, the operation panel 34 includes a display unit 341 for displaying contents of an input from the administrator and the user and a status of the image forming apparatus 1; a menu key 342 for displaying a menu; a selection key 343 for selecting a function displayed on the display unit 341; a cancel key 344 for canceling a function displayed on the display unit 341; a cursor key 345 for scrolling contents displayed on the display unit 341; and a ten key 346 for inputting numerical information. The cursor key 345 has an upper arrow key, a lower arrow key, a left arrow key, and a right arrow key.

In the embodiment, the image processing unit 35 shown in FIG. 2 performs various image processing with respect to the print data stored in the memory 32. Further, the system control unit 36 is connected to the sensor group 40 and the motor 39, so that the system control unit 36 sends a status of the image forming apparatus 1 detected by the sensor group 40 to the CPU 31 and controls rotations of the motor 39.

In the embodiment, the process control unit 37 controls the developing unit 13, the fixing unit 14, the transfer belt 15, and the likes. The interface 38 has a function of connecting the image forming apparatus 1 to a host control unit of the host computer directing the printing operation, so that only the print data and a command are input from the host computer, and a status of the image forming apparatus 1 is output to the host computer.

In the embodiment, the motor 39 transports the printing medium 25, and drives the transfer belt 15 and rollers of the developing unit 13 and the fixing unit 14. The sensor group 40 is formed of a plurality of sensors including the entrance sensor 16, the discharge sensor 17, and the likes for monitoring an operation state of the image forming apparatus 1.

Figure 6:
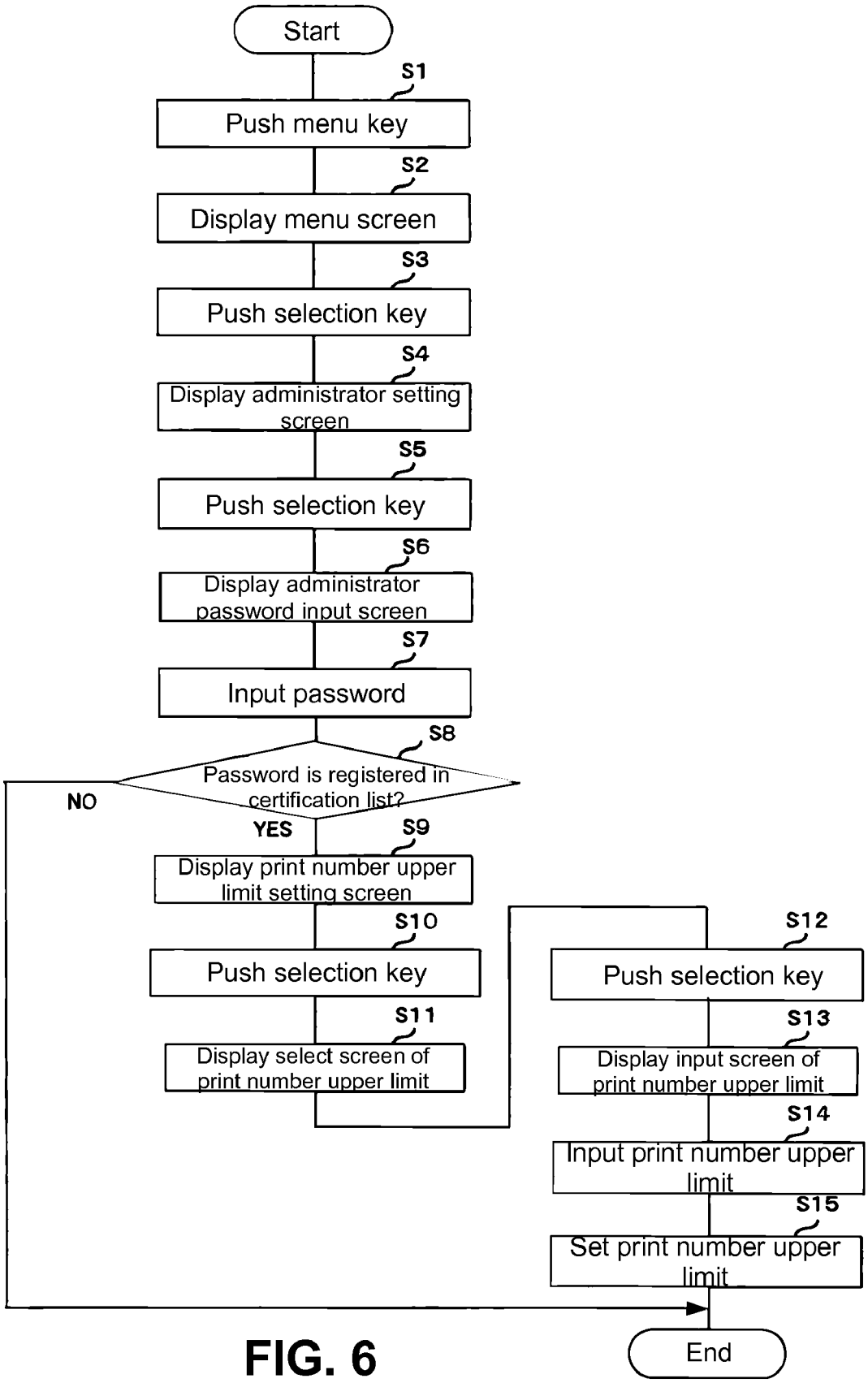
FIG. 6 is a flow chart No. 1 showing an operation of the image forming apparatus according to the first embodiment of the present invention.

An operation of the image forming apparatus 1 will be explained next. The operation is divided into an operation of setting the print number upper limit and an operation of printing continuously (continuous printing). The operation of setting the print number upper limit will be explained first. FIG. 6 is a flow chart No. 1 showing the operation of the image forming apparatus 1 according to the first embodiment of the present invention.

In step S1, when the administrator pushes the menu key 342 of the operation panel 34, the operation panel 34 notifies the CPU 31 that the menu key 342 is pushed. In step S2, the CPU 31 displays a menu screen on the display unit 341 of the operation panel 34. In step S3, the administrator uses the cursor key 345 to move a cursor to an administrator setting screen display item among menu items displayed on the menu screen, and pushes the selection key 343. Accordingly, the operation panel 34 notifies the CPU 31 that the administrator setting screen display item is pushed. In step S4, the CPU 31 displays an administrator setting screen on the display unit 341 of the operation panel 34.

In step S5, the administrator uses the cursor key 345 to move the cursor to an administrator password input screen display item among items displayed on the administrator setting screen, and pushes the selection key 343. Accordingly, the operation panel 34 notifies the CPU 31 that the administrator password input screen display item is pushed. In step S6, the CPU 31 displays an administrator password input screen on the display unit 341 of the operation panel 34.

In step S7, the administrator uses the cursor key 345 to move the cursor to a password input column displayed on the administrator password input screen. Then, the administrator inputs a password in the password input column, and pushes the selection key 343. Accordingly, the operation panel 34 notifies the CPU 31 of the password thus input. In step S8, the CPU 31 refers to a certification list (not shown) stored in the memory 32 for certifying an administrator authorized to set the print number upper limit. Then, the CPU 31 determines whether the password notified from the operation panel 34 is registered in the certification list.

When the CPU 31 determines that the password is not registered in the certification list, the process is completed without setting the print number upper limit. In step S9, when the CPU 31 determines that the password is registered in the certification list, the CPU displays a print number upper limit setting screen on the display unit 341 of the operation panel 34.

In step S10, the administrator uses the cursor key 345 to move the cursor to a select screen display item of valid/invalid of the print number upper limit displayed on the print number upper limit setting screen, and pushes the selection key 343. Accordingly, the operation panel 34 notifies the CPU 31 that the select screen display item of valid/invalid of the print number upper limit is pushed. In step S11, the CPU 31 displays a select screen of valid/invalid of the print number upper limit on the display unit 341 of the operation panel 34.

In step S12, the administrator uses the cursor key 345 to move the cursor to a setting validation item for validating a setting displayed on the select screen of valid/invalid of the print number upper limit, and pushes the selection key 343. Accordingly, the operation panel 34 notifies the CPU 31 that the setting validation item is pushed. In step S13, the CPU 31 displays an input screen of the print number upper limit on the display unit 341 of the operation panel 34.

In step S14, the administrator uses the cursor key 345 to move the cursor to a print number upper limit input column displayed on the input screen of the print number upper limit. Then, the administrator uses the ten key 346 to input the print number upper limit in the print number upper limit input column, and pushes the selection key 343. Accordingly, the operation panel 34 outputs the print number upper limit thus input to the CPU 31 through the system bus 41.

Then, the CPU 31 outputs the print number upper limit thus input from the operation panel 34 to the print number upper limit storage unit 332 in the count control unit 33 through the system bus 41. In step S15, the print number upper limit storage unit 332 stores and sets the print number upper limit input from the CPU 31, thereby completing the process.

Figure 7:
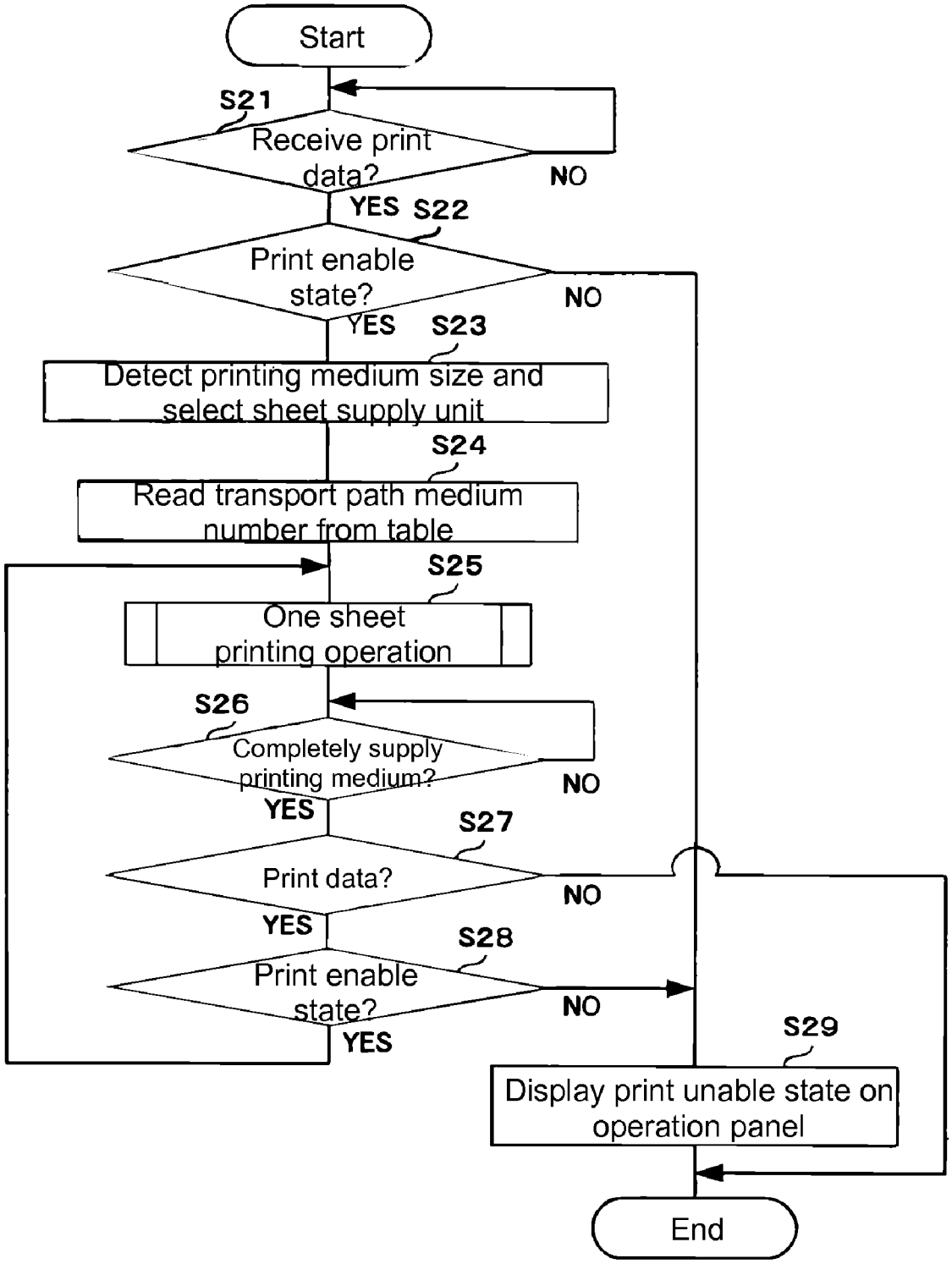
FIG. 7 is a flow chart No. 2 showing the operation of the image forming apparatus according to the first embodiment of the present invention.

The continuous printing operation will be explained next. FIG. 7 is a flow chart No. 2 showing the continuous printing operation of the image forming apparatus 1 according to the first embodiment of the present invention.

In step S21, the CPU 31 monitors a state of the interface 38 all the time, and determines whether the interface 38 receives the print data from the host device. When the CPU 31 determines that the interface 38 does not receive the print data from the host device, the CPU 31 waits until the interface 38 receives the print data from the host device. When the CPU 31 determines that the interface 38 receives the print data from the host device, the CPU 31 reads the print data thus received at the interface 38, and outputs the print data to the memory 32.

Afterwards, the CPU 31 starts the image processing unit 35 to perform the image processing on the print data stored in the memory 32. Under control of the CPU 31, the image processing unit 35 performs the image processing on the print data stored in the memory 32 to create the image data. The CPU 31 transmits the image data thus created at the image processing unit 35 to the memory 32, so that the image data are stored in the memory 32.

In step S22, the CPU 31 refers to the print possibility flag, and determines whether the print possibility flag indicates a print enable state. When the CPU 31 determines that the print possibility flag does not indicate the print enable state, information indicating a print unable state is displayed on the display unit 341 of the operation panel 34, thereby finishing the continuous printing operation (step S29).

In step S23, when the CPU 31 determines that the print possibility flag indicates the print enable state, the CPU 31 detects a printing medium size described in the print data stored in the memory 32. According to the printing medium size thus detected, the CPU 31 selects a sheet supply unit retaining the printing medium 25 to be printed. For example, when the printing medium size described in the print data stored in the memory 32 is the A4 size, the CPU 31 selects the first sheet supply unit 11.

In step S24, when the CPU 31 selects one of the first sheet supply unit 11 and the second sheet supply unit 12 retaining the printing medium 25 to be printed, the CPU 31 reads the transport path medium number describing the printing medium size thus detected from the table 335. Then, the CPU 31 sends the transport path medium number to the addition unit 333.

In step S25, the CPU 31 starts a printing operation for one sheet of the printing medium 25 (one sheet printing operation). In particular, the CPU 31 sends a direction signal to the system control unit 36 to drive the motor 39, so that the system control unit 36 drives the motor 39, thereby transporting the printing medium 25 and driving the rollers of the developing unit 13 and the fixing unit 14. Accordingly, the one sheet printing operation is started for transferring the image data to the printing medium 25. The one sheet printing operation will be explained in more detail later.

In step S26, after the one sheet printing operation, the CPU 31 determines whether the entrance sensor 16 sends a sheet supply signal indicating that a trailing edge of the printing medium 25 passes through the entrance sensor 16, that is, the printing medium 25 is completely supplied. When the CPU 31 determines that the entrance sensor 16 does not send the sheet supply signal indicating that the trailing edge of the printing medium 25 passes through the entrance sensor 16, the CPU 31 waits until the entrance sensor 16 sends the sheet supply signal indicating that the trailing edge of the printing medium 25 passes through the entrance sensor 16.

In step S27, when the CPU 31 determines that the entrance sensor 16 sends the sheet supply signal indicating that the trailing edge of the printing medium 25 passes through the entrance sensor 16, the CPU 31 determines whether the memory 32 stores the print data not read yet. When the CPU 31 determines that the memory 32 does not store the print data not read yet, the CPU 31 finishes the process.

In step S28, when the CPU 31 determines that the memory 32 stores the print data not read yet, the CPU 31 refers to the print possibility flag in the memory 32, and determines whether the print possibility flag indicates the print enable state. When the CPU 31 determines that the print possibility flag does not indicate the print enable state, step S29 is performed, thereby repeating the process described above. On the other hand, when the CPU 31 determines that the print possibility flag indicates the print enable state, step S25 is performed, thereby repeating the process described above.

Figure 8:
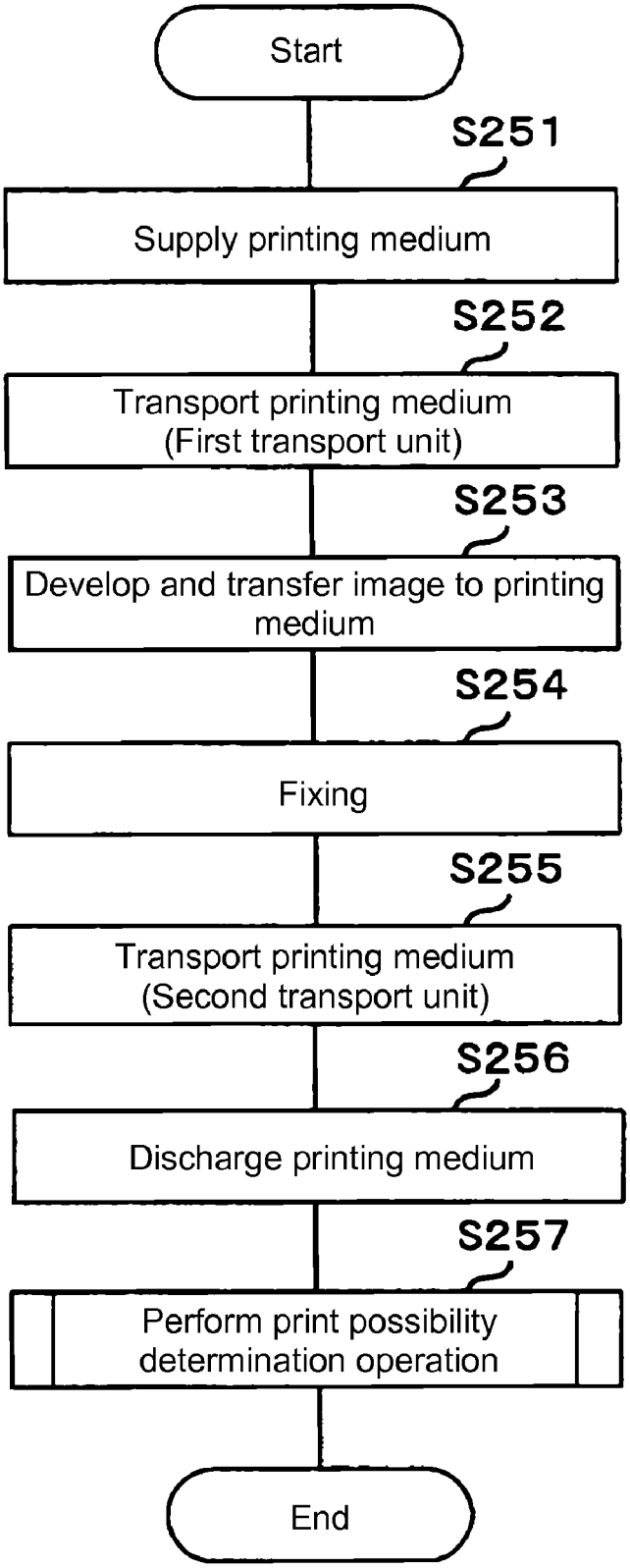
FIG. 8 is a flow chart No. 3 showing an operation in step S25 shown in FIG. 7 according to the first embodiment of the present invention.

The one sheet printing operation in step S25 will be explained next. FIG. 8 is a flow chart No. 3 showing the one sheet printing operation in step S25 shown in FIG. 7 according to the first embodiment of the present invention.

In step S251, when the CPU 31 starts the one sheet printing operation, the printing medium 25 is supplied from the sheet supply unit thus selected. For example, when the printing medium size described in the print data input from the host device is the A4 size, the printing medium 25 having the A4 size is supplied from the first sheet supply unit 11.

In step S252, the first transport unit 18 transports the printing medium 25 to the transfer belt 15, so that the transfer belt 15 transports the printing medium 25 to the developing unit 13. In step S253, the developing unit 13 develops the toner image on the printing medium 25, and transfers the toner image to the printing medium 25. Then, the transfer belt 15 transports the printing medium 25 to the fixing unit 14.

In step S254, the fixing unit 14 fixes the toner image to the printing medium 25 thus transported, and then the printing medium 25 is transported to the second transport unit 19. In step S255, the second transport unit 19 transports the printing medium 25 to the discharge roller 20. In step S256, the discharge roller 20 discharges the printing medium 25 to the discharge sheet tray 21. In step S257, the CPU 31 performs a print possibility determination operation (described later), thereby completing the process.

Figure 9:
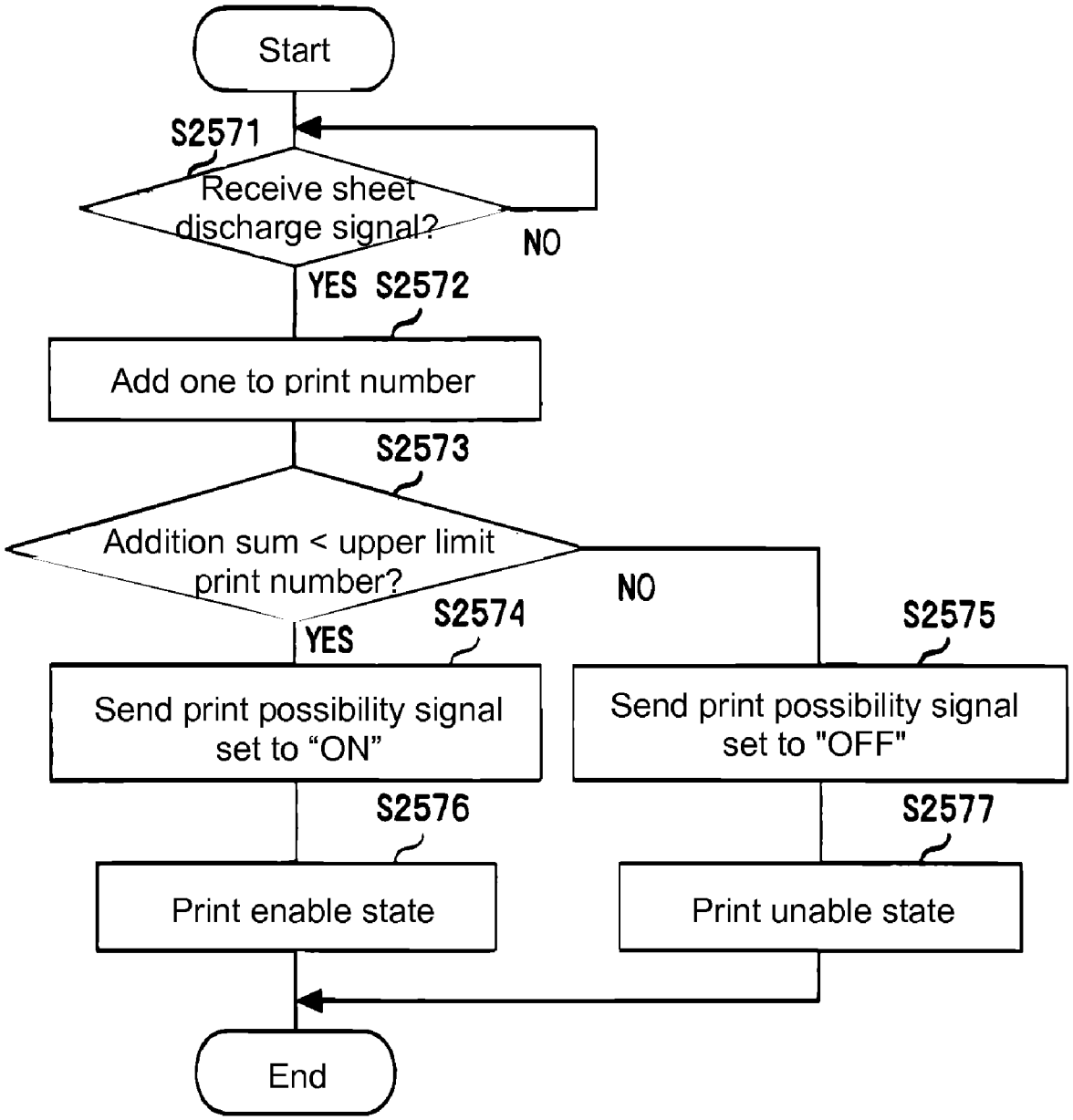
FIG. 9 is a flow chart No. 4 showing an operation in step S257 shown in FIG. 8 according to the first embodiment of the present invention.

The print possibility determination operation will be explained next. FIG. 9 is a flow chart No. 4 showing the print possibility determination operation in step S257 shown in FIG. 8 according to the first embodiment of the present invention.

In step S2571, the CPU 31 determines whether the discharge sensor 17 sends a sheet discharge signal through the system control unit 36 indicating that the printing medium 25 is discharged. When the CPU 31 determines that the discharge sensor 17 does not send the sheet discharge signal indicating that the printing medium 25 is discharged, the CPU 31 waits until the discharge sensor 17 sends the sheet discharge signal. When the CPU 31 determines that the discharge sensor 17 sends the sheet discharge signal indicating that the printing medium 25 is discharged, the CPU 31 sends the addition signal to the print number counter 331 through the system bus 41, so that the print number counter 331 adds one to the print number stored in the count control unit 33.

In step S2572, when the print number counter 331 receives the addition signal from the CPU 31, the print number counter 331 adds one to the print number. Then, the addition unit 333 reads the print number from the print number counter 331 and reads the transport path medium number from the table 335. Then, the addition unit 333 adds the print number to the transport path medium number, and sends the result, i.e., the addition sum, to the comparison unit 334.

In step S2573, when the comparison unit 334 receives the addition sum from the addition unit 333, the comparison unit 334 reads the upper limit print number stored in the print number upper limit storage unit 332, and compares the addition sum with the upper limit print number.

In step S2574, when the comparison unit 334 determines that the addition sum is less than the upper limit print number, the comparison unit 334 sends the print possibility signal set to "ON" indicating that the printing operation is possible to the CPU 31 through the system bus 41.

In step S2575, when the comparison unit 334 determines that the addition sum is equal to or exceeds the upper limit print number, the comparison unit 334 sends the print possibility signal set to "OFF" indicating that the printing operation is impossible to the CPU 31 through the system bus 41.

In step S2576, when the CPU 31 receives the print possibility signal set to "ON" from the comparison unit 334, the CPU 31 sets the print possibility flag to the print enable state, thereby completing the print possibility determination operation. Accordingly, the image forming apparatus 1 is in the state that the printing operation is possible.

In step S2577, when the CPU 31 receives the print possibility signal set to "OFF" from the comparison unit 334, the CPU 31 sets the print possibility flag to the print unable state, thereby completing the print possibility determination operation. Accordingly, the image forming apparatus 1 is in the state that the printing operation is not possible.

In the embodiment described above, the comparison unit 334 compares the addition sum added by the addition unit 333 with the upper limit print number stored in the print number upper limit storage unit 332. When the comparison unit 334 determines that the addition sum exceeds the upper limit print number, the CPU 31 stops supplying the printing medium 25 from the sheet supply unit. Accordingly, when the print number reaches the upper limit print number set in advance, the printing medium 25 is not supplied from the sheet supply unit. As a result, it is possible to prevent the printing medium 25 from being printed beyond the upper limit print number when the printing operation is stopped.

Second Embodiment

A second embodiment of the invention will be described below. Similar to the first embodiment, in the second embodiment, the image forming apparatus 1 is an apparatus such as a printer for printing image data sent from a host device such as a personal computer.

Similar to the first embodiment, the image forming apparatus 1 includes the first sheet supply unit 11; the second sheet supply unit 12; the developing unit 13; the fixing unit 14; the transfer belt 15; the entrance sensor 16; the discharge sensor 17; the first transport unit 18; the second transport unit 19; the discharge roller 20; the discharge sheet tray 21; and the print control system (not shown in FIG. 1) for controlling the printing operation. Components in the second embodiment similar to those in the first embodiment are designated by the same reference numerals, and explanations thereof are omitted.

Similar to the first embodiment, the print control system includes the central processing unit (CPU) 31; the memory 32; the count control unit 33; the operation panel 34; the image processing unit 35; the system control unit 36; the process control unit 37; the interface 38; the motor 39; and the sensor group 40. Further, the system bus 41 is connected to the central processing unit (CPU) 31; the memory 32; the count control unit 33; the operation panel 34; the image processing unit 35; the system control unit 36; the process control unit 37; and the interface 38. The motor 39 and the sensor group 40 are connected to the system control unit 36.

In the second embodiment, except the count control unit 33, the central processing unit (CPU) 31; the memory 32; the operation panel 34; the image processing unit 35; the system control unit 36; the process control unit 37; the interface 38;

the motor 39; and the sensor group 40 have configurations similar to those in the first embodiment, and explanations thereof are omitted.

Figure 10:
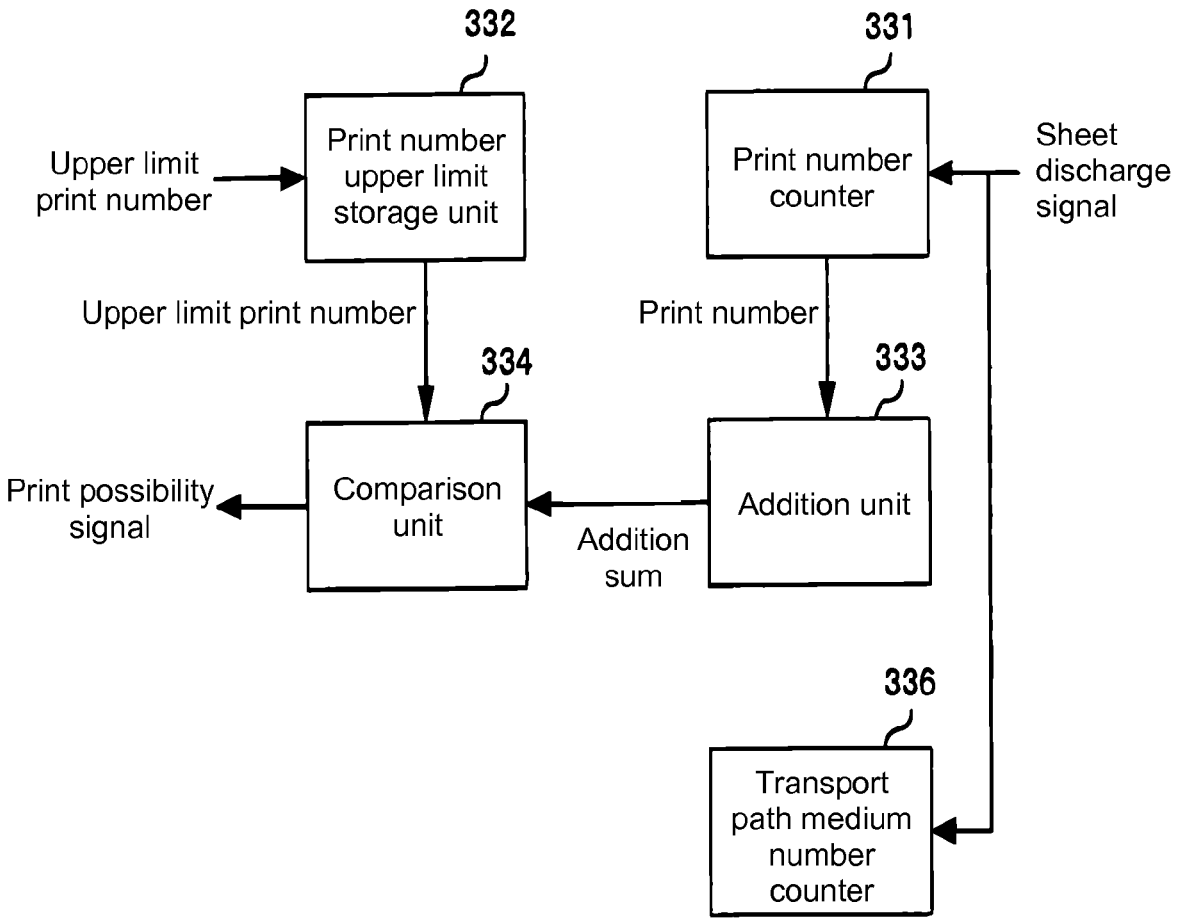
FIG. 10 is a block diagram showing a count control unit in a print control system of an image forming apparatus according to a second embodiment of the present invention.

FIG. 10 is a block diagram showing the count control unit 33 in the print control system of the image forming apparatus 1 according to the second embodiment of the present invention. As shown in FIG. 10, the count control unit 33 includes the print number counter 331; the print number upper limit storage unit 332; the addition unit 333; the comparison unit 334; and a transport path medium number counter 336. The print number counter 331; the print number upper limit storage unit 332; the addition unit 333; and the comparison unit 334 have configurations similar to those in the first embodiment, and explanations thereof are omitted. Accordingly, the count control unit 33 does not have the table 335 in the first embodiment.

In the embodiment, the transport path medium number counter 336 stores the transport path medium number or the number of the printing media 25 in the transport path disposed between the first sheet supply unit 11, the second sheet supply unit 12, and the sheet discharge tray 21 when one of the first sheet supply unit 11 and the second sheet supply unit 12 supplies the printing medium 25, and the printing medium 25 is discharged to the discharge sheet tray 21. Further, the transport path medium number counter 336 updates the transport path medium number by adding one to the transport path medium number when the printing medium 25 is supplied, and by subtracting one from the transport path medium number when the printing medium 25 is discharged.

More specifically, when the CPU 31 sends the addition signal to the transport path medium number counter 336 indicating that the printing medium 25 is supplied, the transport path medium number counter 336 adds one to the transport path medium number. When the CPU 31 sends a subtraction signal to the transport path medium number counter 336 indicating that the printing medium 25 is discharge, the transport path medium number counter 336 subtracts one from the transport path medium number.

An operation of the image forming apparatus 1 in the second embodiment will be explained next. A process of setting the print number upper limit is similar to that in the first embodiment, and explanation thereof is omitted.

Figure 11:
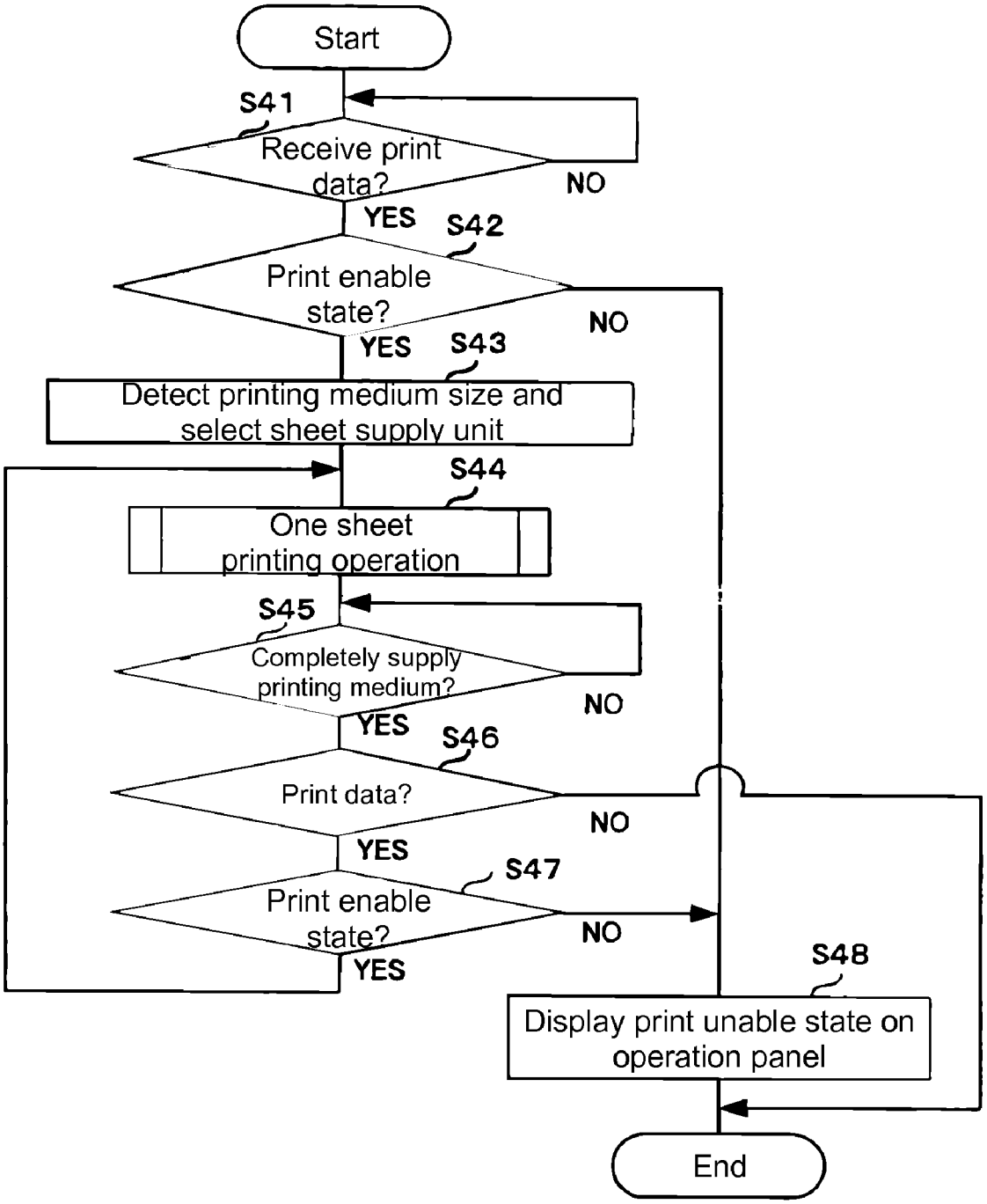
FIG. 11 is a flow chart No. 1 showing an operation of the image forming apparatus according to the second embodiment of the present invention.

The continuous printing operation will be explained first. FIG. 11 is a flow chart No. 1 showing the continuous printing operation of the image forming apparatus 1 according to the second embodiment of the present invention.

In step S41, the CPU 31 monitors a state of the interface 38 all the time, and determines whether the interface 38 receives the print data from the host device. When the CPU 31 determines that the interface 38 does not receive the print data from the host device, the CPU 31 waits until the interface 38 receives the print data from the host device. When the CPU 31 determines that the interface 38 receives the print data from the host device, the CPU 31 reads the print data thus received at the interface 38, and outputs the print data to the memory 32.

Afterwards, the CPU 31 starts the image processing unit 35 to perform the image processing on the print data stored in the memory 32. Under control of the CPU 31, the image processing unit 35 performs the image processing on the print data stored in the memory 32 to create the image data. The CPU 31 transmits the image data thus created at the image processing unit 35 to the memory 32, so that the image data are stored in the memory 32.

In step S42, the CPU 31 refers to the print possibility flag in the memory 32, and determines whether the print possibility flag indicates the print enable state. When the CPU 31 determines that the print possibility flag does not indicate the print enable state, the print unable state is displayed on the display unit 341 of the operation panel 34, thereby finishing the continuous printing operation (step S48).

In step S43, when the CPU 31 determines that the print possibility flag indicates the print enable state, the CPU 31 detects the printing medium size described in the print data stored in the memory 32. According to the printing medium size thus detected, the CPU 31 selects a sheet supply unit retaining the printing medium 25 to be printed according to the printing medium size thus detected. For example, when the printing medium size described in the print data stored in the memory 32 is the A4 size, the CPU 31 selects the first sheet supply unit 11.

In step S44, the CPU 31 starts the one sheet printing operation (described later). In particular, the CPU 31 sends the direction signal to the system control unit 36 to drive the motor 39, so that the system control unit 36 drives the motor 39, thereby transporting the printing medium 25 and driving the rollers of the developing unit 13 and the fixing unit 14. Accordingly, the one sheet printing operation is started for transferring the image data to the printing medium 25.

In step S45, after the one sheet printing operation, the CPU 31 determines whether the entrance sensor 16 sends the sheet supply signal indicating that the trailing edge of the printing medium 25 passes through the entrance sensor 16, that is, the printing medium 25 is completely supplied. When the CPU 31 determines that the entrance sensor 16 does not send the sheet supply signal indicating that the trailing edge of the printing medium 25 passes through the entrance sensor 16, the CPU 31 waits until the entrance sensor 16 sends the sheet supply signal indicating that the trailing edge of the printing medium 25 passes through the entrance sensor 16.

In step S46, when the CPU 31 determines that the entrance sensor 16 sends the sheet supply signal indicating that the trailing edge of the printing medium 25 passes through the entrance sensor 16, the CPU 31 determines whether the memory 32 stores the print data not read yet. When the CPU 31 determines that the memory 32 does not store the print data not read yet, the CPU 31 finishes the process.

In step S47, when the CPU 31 determines that the memory 32 stores the print data not read yet, the CPU 31 refers to the print possibility flag in the memory 32, and determines whether the print possibility flag indicates the print enable state. When the CPU 31 determines that the print possibility flag does not indicate the print enable state, the process returns to step S48, thereby repeating the process described above. On the other hand, when the CPU 31 determines that the print possibility flag indicates the print enable state, the process returns to step S44, thereby repeating the process described above.

Figure 12:
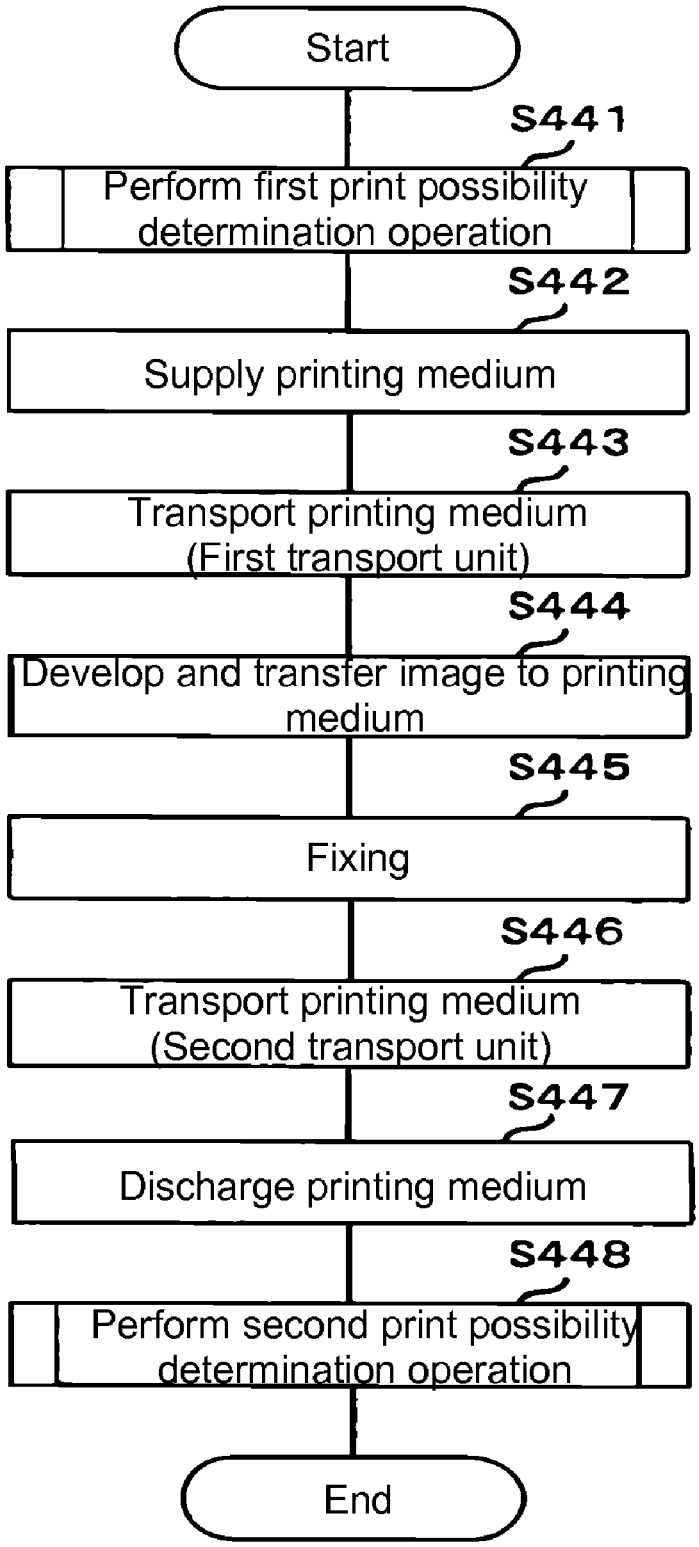
FIG. 12 is a flow chart No. 2 showing an operation in step S44 shown in FIG. 11 according to the second embodiment of the present invention.

The one sheet printing operation in step S44 will be explained next. FIG. 12 is a flow chart No. 2 showing the one sheet printing operation in step S44 shown in FIG. 11 according to the second embodiment of the present invention.

In step S441, when the CPU 31 starts the one sheet printing operation, the CPU 31 performs a first print possibility determination operation. The first print possibility determination operation will be explained in more detail later.

In step S442, after the first print possibility determination operation, the CPU 31 sets the print possibility flag to the print enable state, and the printing medium 25 is supplied from the sheet supply unit thus selected. For example, when the printing medium size described in the print data input from the host device is the A4 size, the printing medium 25 having the A4 size is supplied from the first sheet supply unit 11.

In step S443, the first transport unit 18 transports the printing medium 25 to the transfer belt 15, so that the transfer belt 15 transports the printing medium 25 to the developing unit 13. In step S444, the developing unit 13 develops the toner image on the printing medium 25, and transfers the toner image to the printing medium 25. Then, the transfer belt 15 transports the printing medium 25 to the fixing unit 14.

In step S445, the fixing unit 14 fixes the toner image to the printing medium 25 thus transported, and then the printing medium 25 is transported to the second transport unit 19. In step S446, the second transport unit 19 transports the printing medium 25 to the discharge roller 20. In step S447, the discharge roller 20 discharges the printing medium 25 to the discharge sheet tray 21. In step S448, the CPU 31 performs a second print possibility determination operation, thereby completing the process. The second print possibility determination operation will be explained in more detail later.

Figure 13:
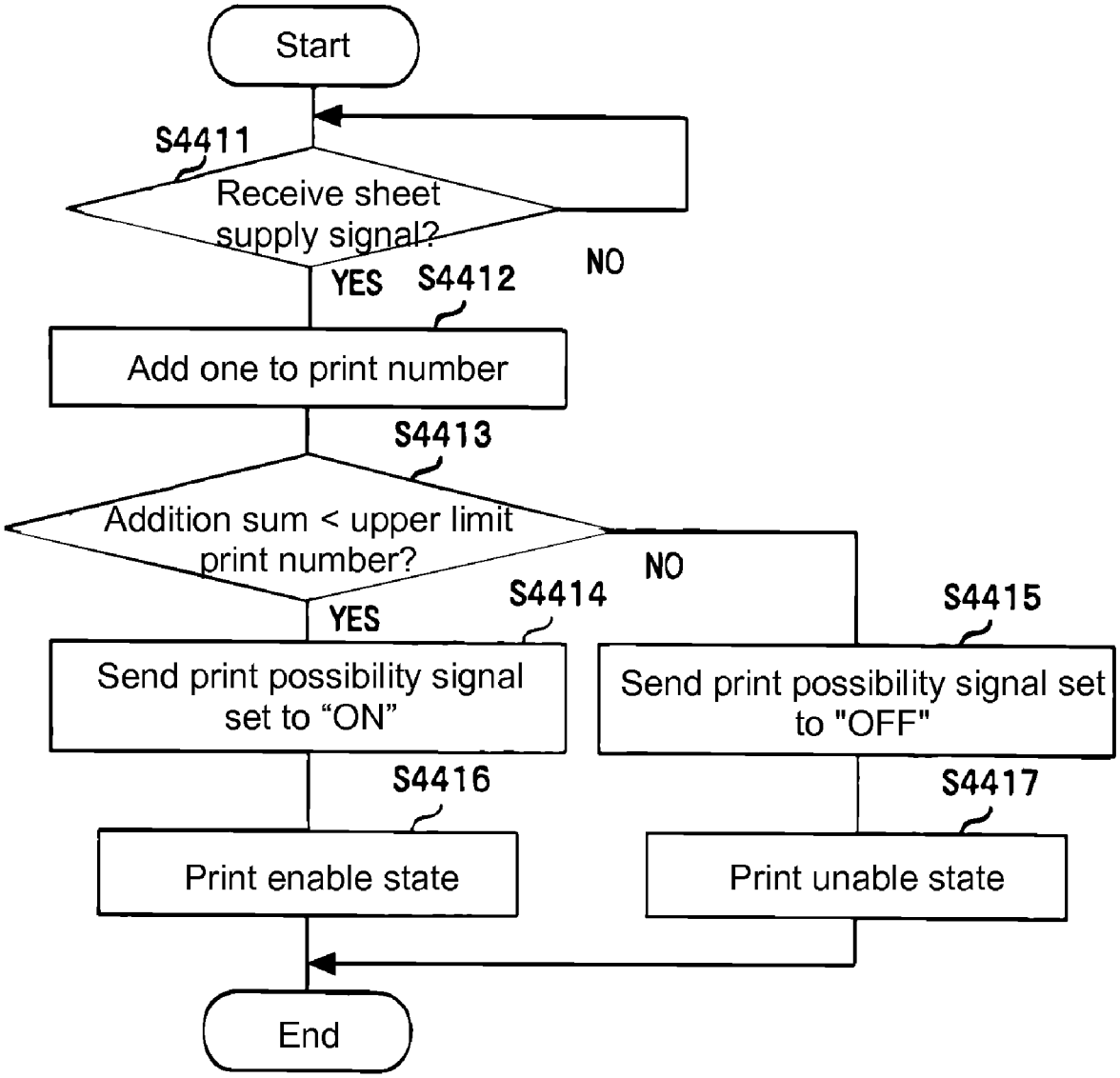
FIG. 13 is a flow chart No. 3 showing an operation in step S441 shown in FIG. 12 according to the second embodiment of the present invention.

The first print possibility determination operation will be explained next. FIG. 13 is a flow chart No. 3 showing the first print possibility determination operation in step S441 shown in FIG. 12 according to the second embodiment of the present invention.

In step S4411, the CPU 31 determines whether the entrance sensor 16 sends a sheet supply signal through the system control unit 36 indicating that the printing medium 25 is supplied. When the CPU 31 determines that the entrance sensor 16 does not send the sheet supply signal indicating that the printing medium 25 is supplied, the CPU 31 waits until the entrance sensor 16 sends the sheet supply signal indicating that the printing medium 25 is supplied.

In step S4412, when the CPU 31 determines that the entrance sensor 16 sends the sheet supply signal indicating that the printing medium 25 is supplied, the CPU 31 sends a sheet supply start signal to the count control unit 33 through the system bus 41. Accordingly, the transport path medium number counter 336 adds one to the transport path medium number indicating the number of the printing media 25 in the transport path. Under the control of the CPU 31, the addition unit 333 reads the transport path medium number from the transport path medium number counter 336. Then, the addition unit 333 adds the print number to the transport path medium number, and sends the result, i.e., the addition sum, to the comparison unit 334.

In step S4413, when the comparison unit 334 receives the addition sum from the addition unit 333, the comparison unit 334 reads the upper limit print number stored in the print number upper limit storage unit 332, and compares the addition sum with the upper limit print number.

In step S4414, when the comparison unit 334 determines that the addition sum is less than the upper limit print number, the comparison unit 334 sends the print possibility signal set to "ON" indicating that the printing operation is possible to the CPU 31 through the system bus 41.

In step S4415, when the comparison unit 334 determines that the addition sum is equal to or exceeds the upper limit print number, the comparison unit 334 sends the print possibility signal set to "OFF" indicating that the printing operation is impossible to the CPU 31 through the system bus 41.

In step S4416, when the CPU 31 receives the print possibility signal set to "ON" from the comparison unit 334, the CPU 31 sets the print possibility flag to the print enable state, thereby completing the first print possibility determination operation. Accordingly, the image forming apparatus 1 is in the state that the printing operation is possible.

In step S4417, when the CPU 31 receives the print possibility signal set to "OFF" from the comparison unit 334, the CPU 31 sets the print possibility flag to the print unable state, thereby completing the first print possibility determination operation. Accordingly, the image forming apparatus 1 is in the state that the printing operation is not possible.

Figure 14:
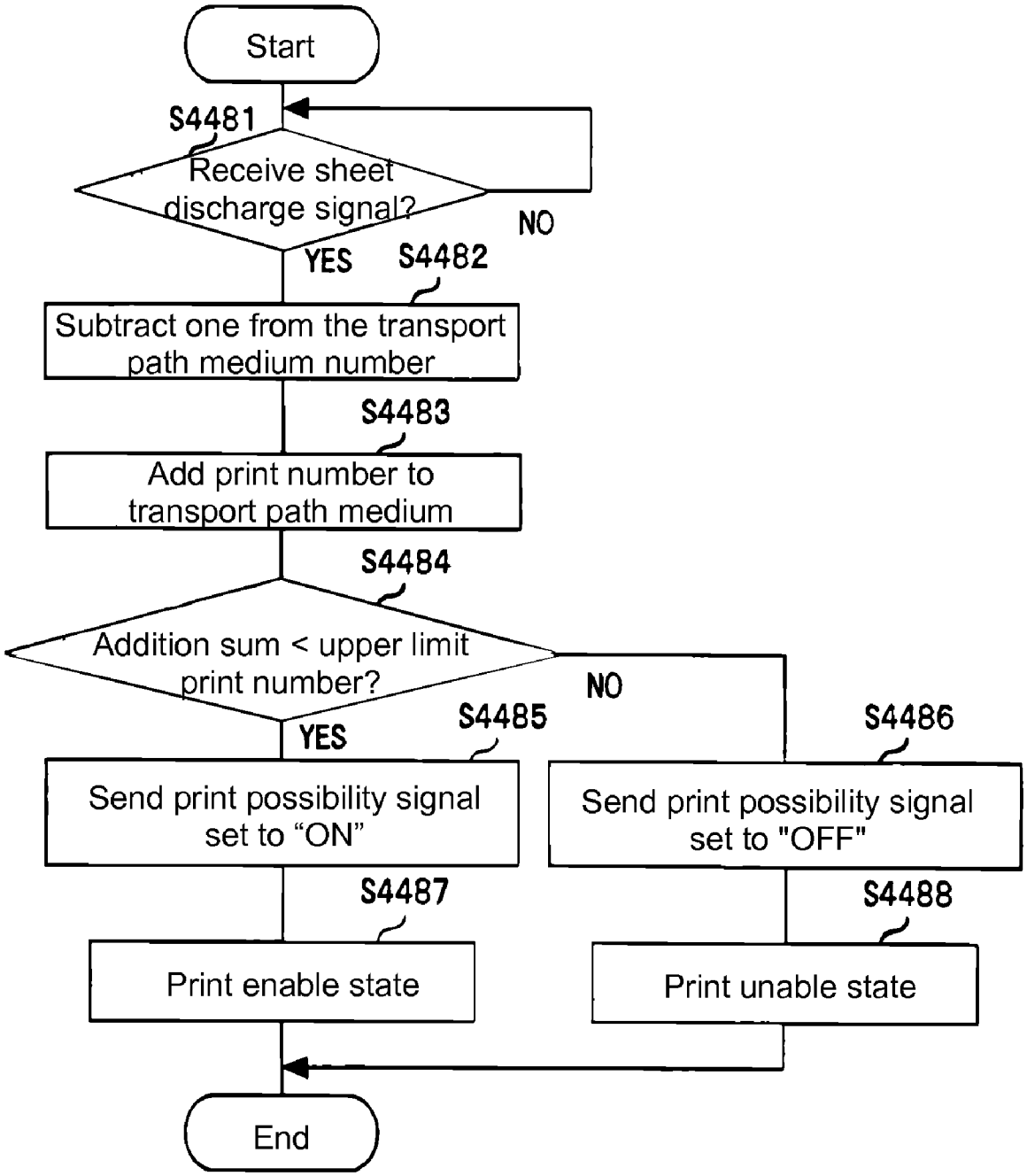
FIG. 14 is a flow chart No. 4 showing an operation in step S448 shown in FIG. 12 according to the second embodiment of the present invention.

The second print possibility determination operation will be explained next. FIG. 14 is a flow chart No. 4 showing the second print possibility determination operation in step S448 shown in FIG. 12 according to the second embodiment of the present invention.

In step S4481, the CPU 31 determines whether the discharge sensor 17 sends the sheet discharge signal through the system control unit 36 indicating that the printing medium 25 is discharged. When the CPU 31 determines that the discharge sensor 17 does not send the sheet discharge signal indicating that the printing medium 25 is discharged, the CPU 31 waits until the discharge sensor 17 sends the sheet discharge signal.

In step S4482, when the CPU 31 determines that the discharge sensor 17 sends the sheet discharge signal indicating that the printing medium 25 is discharged, the CPU 31 sends a discharge signal to the count control unit 33 through the system bus 41. Accordingly, the count control unit 33 subtracts one from the transport path medium number stored in the transport path medium number counter 336.

In step S4483, the addition unit 333 reads the print number from the print number counter 331 and the transport path medium number from the transport path medium number counter 336. Then, the addition unit 333 adds the print number to the transport path medium number, and sends the result, i.e., the addition sum to the comparison unit 334.

In step S4484, when the comparison unit 334 receives the addition sum from the addition unit 333, the comparison unit 334 reads the upper limit print number from the print number upper limit storage unit 332, and compares the addition sum with the upper limit print number.

In step S4485, when the comparison unit 334 determines that the addition sum is less than the upper limit print number, the comparison unit 334 sends the print possibility signal set to "ON" indicating that the printing operation is possible to the CPU 31 through the system bus 41.

In step S4486, when the comparison unit 334 determines that the addition sum is equal to or exceeds the upper limit print number, the comparison unit 334 sends the print possibility signal set to "OFF" indicating that the printing operation is impossible to the CPU 31 through the system bus 41.

In step S4487, when the CPU 31 receives the print possibility signal set to "ON" from the comparison unit 334, the CPU 31 sets the print possibility flag to the print enable state, thereby completing the second print possibility determination operation. Accordingly, the image forming apparatus 1 is in the state that the printing operation is possible.

In step S4488, when the CPU 31 receives the print possibility signal set to "OFF" from the comparison unit 334, the CPU 31 sets the print possibility flag to the print unable state, thereby completing the second print possibility determination operation. Accordingly, the image forming apparatus 1 is in the state that the printing operation is not possible.

As described above, in the second embodiment, the comparison unit 334 compares the addition sum calculated at the print number counter 331 with the upper limit print number stored in the print number upper limit storage unit 332. When the addition sum exceeds the upper limit print number, the CPU 31 stops supplying the printing medium 25 from the sheet supply unit. Accordingly, when the print number reaches the upper limit print number set in advance, the printing medium 25 is not supplied from the sheet supply unit. As a result, it is possible to prevent the printing medium 25 from being printed beyond the upper limit print number when the printing operation is stopped.

Third Embodiment

A third embodiment of the invention will be described below. Similar to the first embodiment, in the third embodiment, the image forming apparatus 1 is an apparatus such as a printer for printing image data sent from a host device such as a personal computer.

Figure 15:
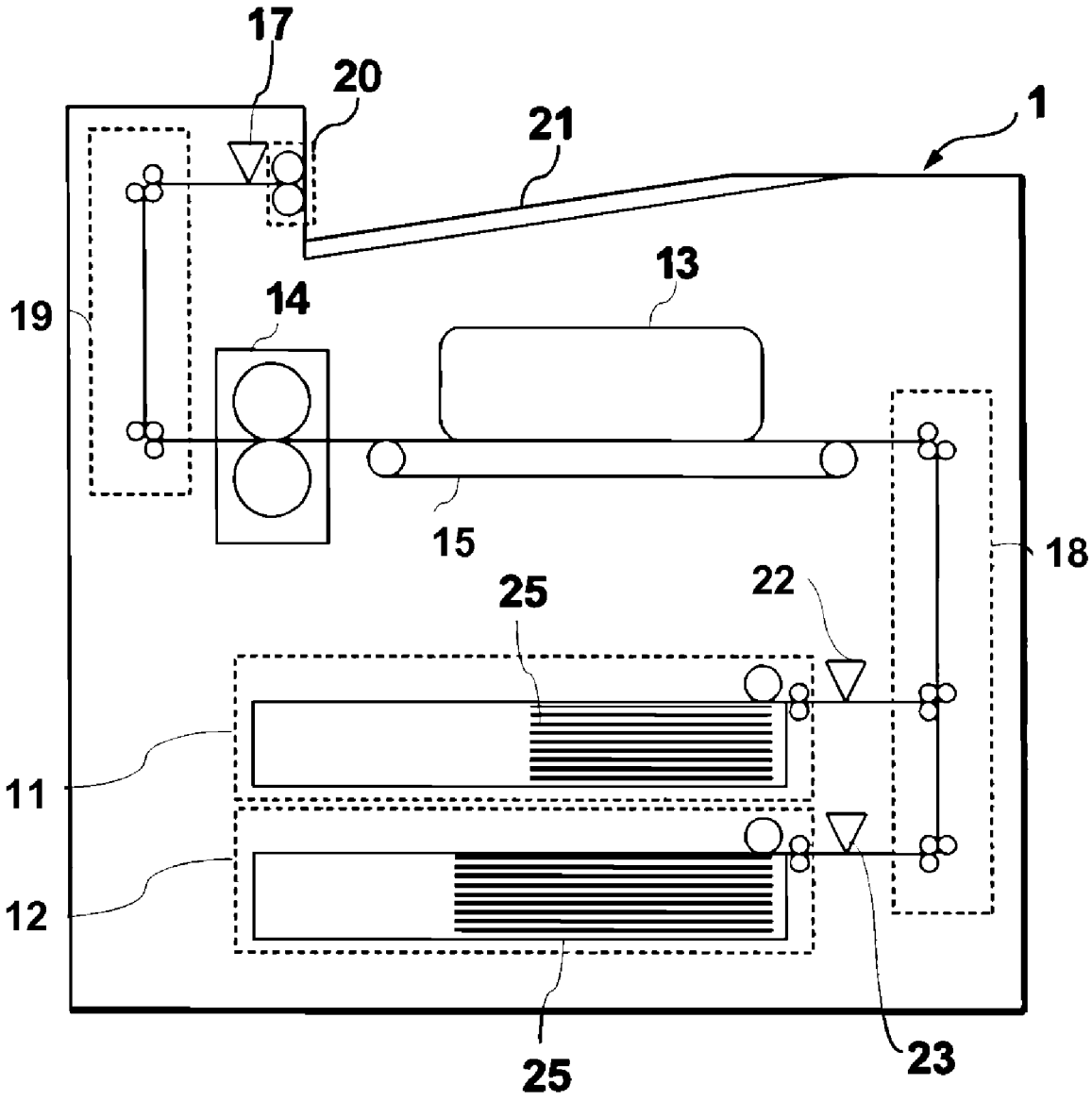
FIG. 15 is a schematic sectional view showing an image forming apparatus according to a third embodiment of the present invention.

FIG. 15 is a schematic sectional view showing the image forming apparatus 1 according to the third embodiment of the present invention. As shown in FIG. 15, the image forming apparatus 1 includes the first sheet supply unit 11; the second sheet supply unit 12; the developing unit 13; the fixing unit 14; the transfer belt 15; the discharge sensor 17; the first transport unit 18; the second transport unit 19; the discharge roller 20; the discharge sheet tray 21; a first entrance sensor 22; a second entrance sensor 23; and the print control system (not shown in FIG. 15) for controlling the printing operation.

Components in the third embodiment similar to those in the first and second embodiments are designated by the same reference numerals, and explanations thereof are omitted. In the third embodiment, instead of the entrance sensor 16, the image forming apparatus 1 is provided with the first entrance sensor 22 and the second entrance sensor 23.

In the third embodiment, the first entrance sensor 22 is disposed near the first sheet supply unit 11 for detecting the printing medium 25 supplied from the first sheet supply unit 11. Further, the second entrance sensor 23 is disposed near the second sheet supply unit 12 for detecting the printing medium 25 supplied from the second sheet supply unit 12.

Similar to the first embodiment, the print control system includes the central processing unit (CPU) 31; the memory 32; the count control unit 33; the operation panel 34; the image processing unit 35; the system control unit 36; the process control unit 37; the interface 38; the motor 39; and the sensor group 40. Further, the system bus 41 is connected to the central processing unit (CPU) 31; the memory 32; the count control unit 33; the operation panel 34; the image processing unit 35; the system control unit 36; the process control unit 37; and the interface 38. The motor 39 and the sensor group 40 are connected to the system control unit 36.

In the third embodiment, except the count control unit 33, the central processing unit (CPU) 31; the memory 32; the operation panel 34; the image processing unit 35; the system control unit 36; the process control unit 37; the interface 38; the motor 39; and the sensor group 40 have configurations similar to those in the first embodiment, and explanations thereof are omitted.

In the third embodiment, the count control unit 33 includes the print number counter 331; the print number upper limit storage unit 332; the addition unit 333; the comparison unit 334; and the table 335. The print number counter 331; the print number upper limit storage unit 332; the addition unit 333; and the comparison unit 334 have configurations similar to those in the first embodiment, and explanations thereof are omitted.

FIG. 16 is a schematic view showing an example of the table 335 in the print control system of the image forming apparatus 1 according to the third embodiment of the present invention. As shown in FIG. 16, the table 335 includes the transport path medium number supplied from the first sheet supply unit 11 and the transport path medium number supplied from the second sheet supply unit 12 for each size of the printing medium 25.

An operation of the image forming apparatus 1 in the third embodiment will be explained next. A process of setting the print number upper limit is similar to that in the first embodiment, and explanation thereof is omitted.

The continuous printing operation will be explained first with reference to FIG. 7. It is supposed that the printing medium 25 having the A4 size is placed in the first sheet supply unit 11, and the printing medium 25 having the A3 size is placed in the second sheet supply unit 12.

In step S21, the CPU 31 monitors the state of the interface 38 all the time, and determines whether the interface 38 receives the print data from the host device. When the CPU 31 determines that the interface 38 does not receive the print data from the host device, the CPU 31 waits until the interface 38 receives the print data from the host device. When the CPU 31 determines that the interface 38 receives the print data from the host device, the CPU 31 reads the print data thus received at the interface 38, and outputs the print data to the memory 32.

Afterwards, the CPU 31 starts the image processing unit 35 to perform the image processing on the print data stored in the memory 32. Under the control of the CPU 31, the image processing unit 35 performs the image processing on the print data stored in the memory 32 to create the image data. The CPU 31 transmits the image data thus created at the image processing unit 35 to the memory 32, so that the image data are stored in the memory 32.

In step S22, the CPU 31 refers to the print possibility flag, and determines whether the print possibility flag indicates the print enable state. When the CPU 31 determines that the print possibility flag does not indicate the print enable state, the print unable state is displayed on the display unit 341 of the operation panel 34, thereby finishing the continuous printing operation (step S29).

In step S23, when the CPU 31 determines that the print possibility flag indicates the print enable state, the CPU 31 detects the printing medium size described in the print data stored in the memory 32. According to the printing medium size thus detected, the CPU 31 selects one of the first sheet supply unit 11 and the second sheet supply unit 12 retaining the printing medium 25 to be printed. For example, when the printing medium size described in the print data stored in the memory 32 is the A4 size, the CPU 31 selects the first sheet supply unit 11.

In step S24, the CPU 31 selects one of the first sheet supply unit 11 and the second sheet supply unit 12 retaining the printing medium 25 to be printed, the CPU 31 reads one of the first sheet supply unit 11 and the second sheet supply unit 12 thus selected, and the transport path medium number describing the printing medium size thus detected from the table 335. Then, the CPU 31 sends the transport path medium number to the addition unit 333.

In step S25, the CPU 31 starts the one sheet printing operation. In particular, the CPU 31 sends the direction signal to the system control unit 36 to drive the motor 39, so that the system control unit 36 drives the motor 39, thereby transporting the printing medium 25 and driving the rollers of the developing unit 13 and the fixing unit 14. Accordingly, the one sheet printing operation is performed as described above.

In step S26, after starting the one sheet printing operation, the CPU 31 determines whether the first entrance sensor 22 or the second entrance sensor 23 sends the sheet supply signal indicating that the trailing edge of the printing medium 25 passes through the first entrance sensor 22 or the second entrance sensor 23, that is, the printing medium 25 is completely supplied. When the CPU 31 determines that both of the first entrance sensor 22 and the second entrance sensor 23 do not send the sheet supply signal indicating that the trailing edge of the printing medium 25 passes through the first entrance sensor 22 and the second entrance sensor 23, the CPU 31 waits until the first entrance sensor 22 or the second entrance sensor 23 sends the sheet supply signal indicating that the trailing edge of the printing medium 25 passes through the first entrance sensor 22 or the second entrance sensor 23.

In step S27, when the CPU 31 determines that the first entrance sensor 22 or the second entrance sensor 23 sends the sheet supply signal indicating that the trailing edge of the printing medium 25 passes through the first entrance sensor 22 or the second entrance sensor 23, the CPU 31 determines whether the memory 32 stores the print data not read yet. When the CPU 31 determines that the memory 32 does not store the print data not read yet, the CPU 31 finishes the process.

In step S28, when the CPU 31 determines that the memory 32 stores the print data not read yet, the CPU 31 refers to the print possibility flag in the memory 32, and determines whether the print possibility flag indicates the print enable state. When the CPU 31 determines that the print possibility flag does not indicate the print enable state, the process returns to step S29, thereby repeating the process described above. On the other hand, when the CPU 31 determines that the print possibility flag indicates the print enable state, the process returns to step S25, thereby repeating the process described above.

As described above, in the third embodiment, the first entrance sensor 22 is disposed near the first sheet supply unit 11 for detecting the printing medium 25 supplied from the first sheet supply unit 11. Accordingly, it is possible to quickly detect that the printing medium 25 is supplied, thereby increasing a speed of the printing operation.

In the embodiments described above, the image forming apparatus is applied to the printer, and may be applicable to a copier, a facsimile, a multi-function device combining a scanner and a printer, and the likes.

The disclosure of Japanese Patent Application No. 2006-262689, filed on Sep. 27, 2006 is incorporated in the application by reference.

While the invention has been explained with reference to the specific embodiments of the invention, the explanation is illustrative and the invention is limited only by the appended claims.

What is claimed is:

1. An image forming apparatus for printing on printing media with various sizes, comprising:

a sheet supply unit for supplying a specific printing medium, said sheet supply unit including a plurality of sheet supply sections according to the various sizes of the printing media;

a sheet discharge, unit for discharging the specific printing medium after an image is transferred to the specific printing medium;

a printing medium size detection unit for detecting a size of the specific printing media;

a selection unit for selecting one of the sheet supply sections so that the specific printing medium is supplied from the one of the sheet supply sections;

a transport path medium number storage unit for storing a transport path medium number of the printing media in a transport path disposed between the sheet supply unit and the sheet discharge unit per each of the sheet supply sections according to the various sizes of the printing media when the sheet supply unit supplies the printing media and the sheet discharge unit discharges the printing media;

a transport path medium number reading unit for reading the transport path medium number corresponding to the size of the specific printing medium detected with the printing medium size detection unit according to the one of the sheet supply sections;

a discharge number storage unit for storing a discharge number of the printing media discharged from the sheet discharge unit, and for updating the discharge number by adding one to the discharge number when the sheet discharge unit discharges the specific printing medium;

an upper limit print number storage unit for storing an upper limit print number of the printing media that the sheet discharge unit is capable of discharging;

an addition unit for calculating an addition sum of the discharge number and the transport path medium number read with the transport path medium number reading unit when the sheet discharge unit discharges the specific printing medium;

a number comparison unit for comparing the addition sum with the upper limit print number; and a sheet supply stop unit for stopping the sheet supply unit when the addition sum becomes equal to or greater than the upper limit print number.

2. The image forming apparatus according to claim 1, further comprising an upper limit print number setting unit for setting the upper limit print number.

3. The image forming apparatus according to claim 1, wherein said sheet supply unit is arranged so that a length of the transport path between the one of the sheet supply sections and the sheet discharge unit is different from that of the transport path between another of the sheet supply sections and the sheet discharge unit.

* * * * *